US006123406A

United States Patent [19]

Imai

[11] Patent Number: 6,123,406

[45] **Date of Patent: *Sep. 26, 2000**

[54] PRINTER WITH RESIDUAL INK DETECTION

[75] Inventor: Takashi Imai, Yokohama, Japan

[73] Assignee: Canon Kabushiki Kaisha, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/811,291

[22] Filed: Mar. 4, 1997

[30] Foreign Application Priority Data

Mar. 6, 1996 [JP] Japan ..... 8-049184
Mar. 6, 1996 [JP] Japan ..... 8-049186

[51] Int. Cl.[7] ..... B41J 2/01

[52] U.S. Cl. ..... 347/19; 347/7

[58] Field of Search ..... 347/7, 19, 14, 347/23

[56] References Cited

U.S. PATENT DOCUMENTS

| | | | |
|---|---|---|---|
| 4,296,418 | 10/1981 | Yamazaki et al. | 347/28 |
| 4,313,124 | 1/1982 | Hara | 347/57 |
| 4,345,262 | 8/1982 | Shirato et al. | 347/10 |
| 4,459,600 | 7/1984 | Sato et al. | 347/47 |
| 4,463,359 | 7/1984 | Ayata et al. | 347/56 |
| 4,493,993 | 1/1985 | Kanamuller et al. | 250/222.1 |
| 4,558,333 | 12/1985 | Sugitani et al. | 347/65 |
| 4,608,577 | 8/1986 | Hori | 347/66 |
| 4,723,129 | 2/1988 | Endo et al. | 347/56 |
| 4,740,796 | 4/1988 | Endo et al. | 347/56 |
| 4,896,172 | 1/1990 | Nozawa et al. | 347/17 |
| 4,970,534 | 11/1990 | Terasawa et al. | 347/32 |
| 5,276,467 | 1/1994 | Meyer et al. | 347/19 |
| 5,488,395 | 1/1996 | Takayanagi et al. | 347/7 |
| 5,508,722 | 4/1996 | Saito et al. | 347/17 |

FOREIGN PATENT DOCUMENTS

| | | |
|---|---|---|
| 0 110 634 | 6/1984 | European Pat. Off. . |
| 0 380 056 | 8/1990 | European Pat. Off. . |
| 0 437 062 | 7/1991 | European Pat. Off. . |

(List continued on next page.)

*Primary Examiner*—John Barlow
*Assistant Examiner*—Craig A. Hallacher
*Attorney, Agent, or Firm*—Fitzpatrick, Cella, Harper & Scinto

[57] ABSTRACT

A printer which performs accurate ink detection even if its operational environment has changed, and a facsimile apparatus using the printer. When printing of one page of print sheet has been completed, printhead is moved to a position opposite to ink detection position sensor and ink detection is performed. If it is determined that ink is exhausted, the printhead is moved in a printhead-moving direction by a slight amount (±ΔL) from a normal detection position, and the ink detection is performed again. Printing is controlled based on the result of the retried detection. Print control may be performed such that upon estimating a residual ink amount (x), a value obtained from the result of ink detection is compared with two threshold values (TH1, TH2), and if TH1≦x (sufficient ink remains) holds, the printing is performed; if TH2≦x≦TH1 (residual ink amount is small) holds, alarm processing such as displaying a warning message on LED, turning LED on, and emitting an alarm sound from speaker is performed. If x<TH2 (ink is exhausted) holds, the printing is suppressed.

31 Claims, 6 Drawing Sheets

FOREIGN PATENT DOCUMENTS

| | | |
|---|---|---|
| 0 443 832 | 8/1991 | European Pat. Off. . |
| 443245 | 8/1991 | European Pat. Off. . |
| 569203 | 11/1993 | European Pat. Off. . |
| 744295 | 11/1996 | European Pat. Off. . |
| 32 46 707 | 6/1984 | Germany . |
| 39 25 048 | 1/1991 | Germany . |
| 52-42966 | 4/1977 | Japan . |
| 54-056847 | 5/1979 | Japan . |
| 54-56847 | 5/1979 | Japan . |
| 58-217365 | 12/1983 | Japan . |
| 59-12857 | 1/1984 | Japan . |
| 59-42966 | 3/1984 | Japan . |
| 59-123670 | 7/1984 | Japan . |
| 59-138461 | 8/1984 | Japan . |
| 60-071260 | 4/1985 | Japan . |
| 60-71260 | 4/1985 | Japan . |
| 62-156965 | 7/1987 | Japan . |
| 62-253457 | 11/1987 | Japan . |
| 2-4521 | 1/1990 | Japan . |
| 2-187363 | 7/1990 | Japan . |
| 4-31058 | 2/1992 | Japan . |

PRINTER WITH RESIDUAL INK DETECTION

BACKGROUND OF THE INVENTION

This invention relates to a printer and facsimile apparatus using the printer and, more particularly to a printer which performs printing in accordance with an ink-jet printing method and facsimile apparatus using the printer.

Conventional printers, which perform printing in accordance with an ink-jet printing method (ink-jet printers) and facsimile apparatuses using the ink-jet printer, perform ink detection or ink-discharge status detection by using a photo-interruptive type sensor. The existence/absence of residual ink within the apparatus is determined based on the detection result. If it is determined that the ink is exhausted, printing operation is stopped, and notification is made to request a user to supply ink. For example, a message requesting to exchange an ink tank or ink cartridge is displayed, or an alarm lamp is turned on, or alarm sound is emitted.

In this ink detection, sometimes it is erroneously determined that the ink is exhausted (referred to "erroneous detection") although the ink actually remains due to change of capacity of ink cartridge, change of the operational environment where the apparatus is placed, change of incident angle of extraneous light incident upon the apparatus. To prevent this erroneous detection, the position for ink detection by using the photo-interrupter type sensor is adjusted when the ink cartridge is exchanged for a new cartridge.

However, in the conventional art, the adjustment on the ink detection position is performed only when the ink cartridge is exchanged for new one. In a case where the ink-cartridge capacity or the apparatus' operational environment has changed but the ink cartridge has not been exchanged for new one, still it is erroneously determined that the ink has exhausted although the ink actually remains.

Accordingly, the facsimile apparatus, using the printer as its printing unit, does not perform printing with respect to image data received after such erroneous detection, and the received data is stored into an image memory. If this continues for a long time, the image memory becomes full, and finally the reception operation cannot be performed until the ink cartridge is exchanged for new one.

Further, in a case where the result of ink detection has abruptly changed from "ink remains" to "ink exhausted", if there is no spare ink cartridge or ink tank, ink replacement cannot be performed immediately. If this occurs, in case of printer, "print-disable" status continues for hours. In case of facsimile apparatus, after the image memory has been filled with received image data, reception operation cannot be normally performed any longer, accordingly, received image data is lost.

Further, in a facsimile apparatus, if print control is performed to continue printing even with very little amount of residual ink, the quality of printed image is degraded. If the printed image is illegible, the print sheet is wasted; in addition, the facsimile apparatus determines that print operation has been normally performed and deletes received image data from the image memory. Thus the received image data cannot be restored.

Further, in a color printer and a facsimile apparatus having the color printer to realize a color printing function, ink-discharge condition such as ink-discharge amount, discharge frequency, discharge speed, and ink-characteristic conditions such as ink density, reflection light, transmission light amount and the like, are different dependent upon each color ink. This disturbs accurate ink detection.

SUMMARY OF THE INVENTION

Accordingly, it is an object of the present invention to provide a printer which can determine whether or not ink remains, based on accurate ink discharge status detection even if the operational environment where the apparatus is set has changed, and a facsimile apparatus using the printer.

According to one aspect of the present invention, the foregoing object is attained by providing a printer for performing print operation such that a printhead discharges ink on a printing medium, comprising: an ink tank containing the ink; print means for performing printing by using said printhead detection means, including a light-emitting device for emitting light and a photo-reception device for receiving the light, for detecting a received light amount at the photo-reception device for ink detection, such that the printhead discharges ink and the ink interrupts the light from the light-emitting device to the photo-reception device; determination means for comparing the received light amount detected by the detection means with a predetermined threshold value, and determining whether ink remains or is exhausted, based on the result of comparison; and detection control means for shifting the printhead based on the result of determination by the determination means, and controlling the detection means to retry the ink detection at the shifted position.

In accordance to the present invention as described above, upon printing by discharging ink from a printhead toward a print medium, ink detection is performed by using detection means including a light emitting device for emitting light and a photo-reception device for receiving the light from the light emitting device. The ink discharge is made such that ink droplets from the printhead pass between the light emitting device and photo-reception device. At the photo-reception device, the amount of received light is detected. The received light amount is compared with a predetermined threshold value, and it is determined that ink remains/exhausted from the result of comparison. Based on the determination, an ink-discharge position at which the printhead performs test ink discharge is moved to another ink-discharge position, then ink detection is performed again.

If it is determined that the ink remains, the second ink detection is not performed. Preferably, if it is determined at the second detection that ink remains, the detection means performs ink detection, from the next page, at the second ink-discharge position.

Further, ink detection may be performed by using a sensor including a light emitting device such as a LED for emitting visible or infrared light, and a photo-reception device such as a photo-transistor for receiving the light from the light emitting device. Note that in a case where the printhead performs color printing by discharging a plurality of color ink, the predetermined threshold value is set for each color.

Further, it may be arranged such that ink detection is performed at predetermined intervals, otherwise at a predetermined timing, such as after the completion of printing for one print sheet.

Further, it may be arranged such that if it is determined based on the result of the second ink detection that the ink is exhausted, the printing is stopped. Otherwise, it may be arranged such that if no ink droplet has been detected during several ink detection times, it is determined that the ink is exhausted, and the printing is stopped.

Note that the printhead may be an ink-jet printhead which performs printing by discharging ink, or a printhead which discharges ink by utilizing thermal energy and which have thermal-energy generators for generating thermal energy to be provided to the ink.

According to another aspect of the present invention, the foregoing object is attained by providing a facsimile apparatus using the above described printer.

It is another object of the present invention to provide a printer which can perform print control based on the amount of residual ink.

The above object is attained by providing a printer in which, upon ink detection using a photo-interruptive type sensor, a value converted from a received light amount at a photo-reception device is compared with a plurality of threshold values, and the amount of residual ink is estimated.

It may be arranged such that alarming is activated based on the result of the estimation of the amount of residual ink, to notify that the amount of residual ink is small. The alarm may be made by displaying a warning message on an LCD, turning on an alarm lamp of LED, or emitting an alarm sound from a speaker.

Note that when the printhead performs color printing by discharging a plurality of color ink, the plurality of threshold values are set for each ink color.

Further, if it is determined based on the result of ink detection that the ink is exhausted, the printing may be stopped.

The present invention is particularly advantageous since even if the result of ink detection is questionable due to change of the operational environment where the apparatus is placed, or the like, the printhead is moved to an appropriate position for ink detection and the detection can be performed there.

Since the value converted from the reception light amount at the photo-reception device upon ink detection is compared with the plurality of threshold values so as to estimate the amount of residual ink in an ink tank containing the ink, print control based on the residual ink amount can be performed. For example, an alarm may be activated to notify the user that the amount of residual ink is small. The user then exchanges the ink tank before the ink becomes exhausted or prepares a spare ink tank, which avoids long-hours interruption in printing due to ink exhaustion.

Other objects and advantages besides those discussed above shall be apparent to those skilled in the art from the description of a preferred embodiment of the invention which follows. In the description, reference is made to accompanying drawings, which form a part thereof, and which illustrate an example of the invention. Such example, however, is not exhaustive of the various embodiments of the invention, and therefore reference is made to the claims which follow the description for determining the scope of the invention.

BRIEF DESCRIPTION OF THE DRAWINGS

The accompanying drawings, which are incorporated in and constitute a part of the specification, illustrate embodiments of the invention and, together with the description, serve to explain the principles of the invention.

DETAILED DESCRIPTION OF THE PREFERRED EMBODIMENTS

Preferred embodiments of the present invention will now be described in detail in accordance with the accompanying drawings.

Figure 1:
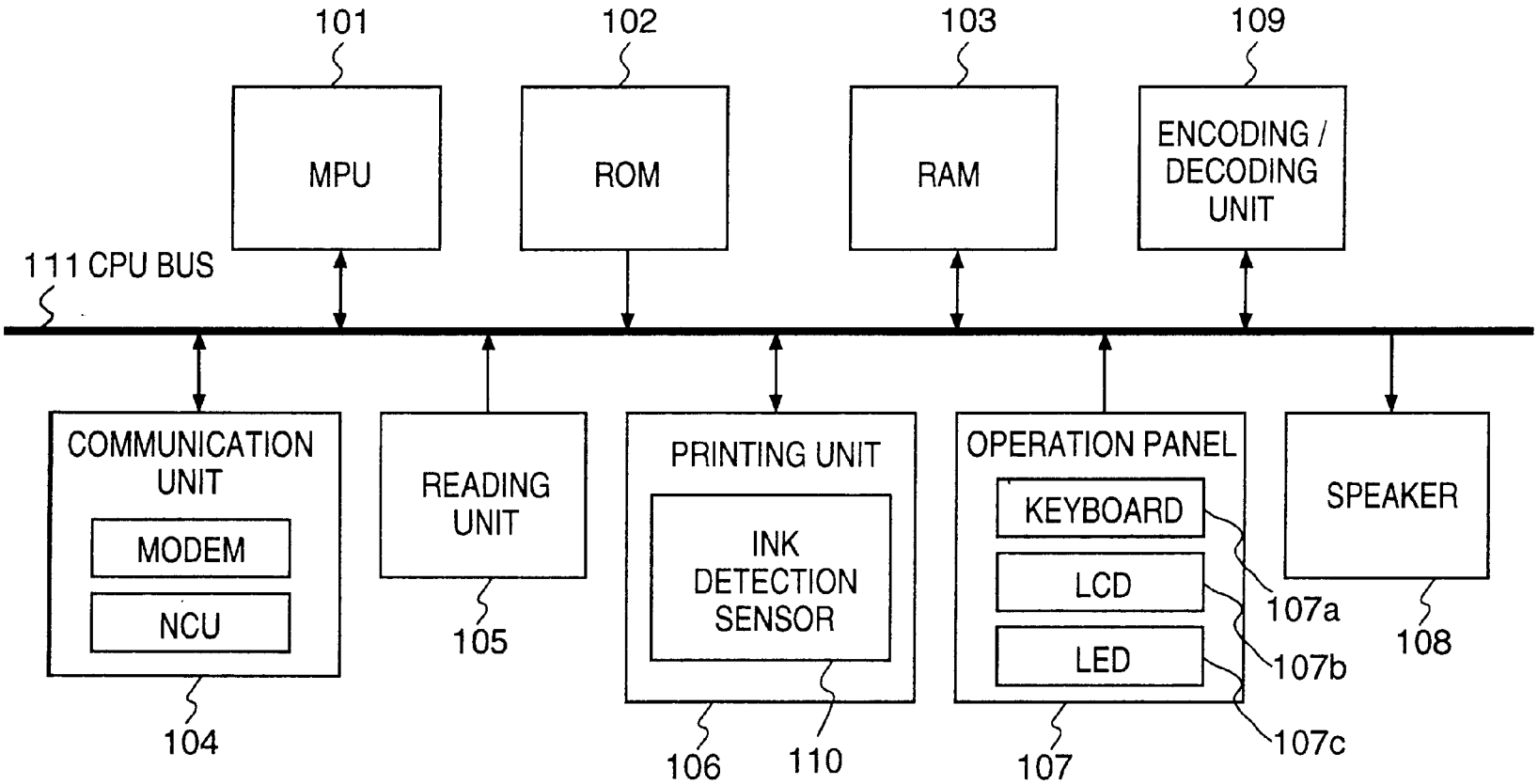
FIG. 1 is a interrupt diagram showing the construction of a facsimile apparatus as a representative embodiment of the present invention.

FIG. 1 shows the construction of a facsimile apparatus which is a representative embodiment and commonly employed in the following two embodiments of the present invention. The facsimile apparatus has a printer which performs printing by using a printhead in accordance with an ink-jet printing method.

In FIG. 1, numeral 101 denotes an MPU which controls the overall facsimile apparatus; 102, a ROM in which control programs for controlling facsimile communication operation, image reading and print operation, table data and the like, are stored; 103, a RAM which is used as a work area for MPU 101 to execute the control programs and/or which is used as an image memory for storing transmission/reception data or print data; 104, a communication unit, comprising an NCU, a MODEM (including DTMF transceiver, tone-signal transmitter and tone-signal receiver), a call-signal (CI) detector and the like, for transmitting/receiving communication data; and 105, a reading unit, comprising an optical scanner for reading an original image, an image processing LSI for performing image processing on read image, and the like, for performing reading control.

Numeral 106 denotes a printing unit, comprising a printhead and an exchangeable ink cartridge or ink tank, for performing image printing such as copying, print-outputting a received facsimile image, various reporting and the like; 107, an operation panel comprising a keyboard 107*a* having ten-keys, single-touch keys, printer-mode keys and the like, an LCD 107*b*, an LED 107*c*, and the like; 108, a speaker which emits various operation sounds, an alarm sound and a pseudo-call sound; 109, an encoding/decoding unit which performs encoding and decoding of image data; 110, a ink detection sensor which performs ink detection by a photo-interruptive method; and 111, a CPU bus connecting the respective elements with each other.

In accordance with ink detection to be described in the following two embodiments, the LCD 107*b* displays a warning message, the LED 107*c* as an alarm lamp is turned on, and the speaker 108 emits an alarm sound.

Next, the two embodiments of print control with ink detection by the facsimile apparatus having the above construction will be described.

First Embodiment

Figure 2:
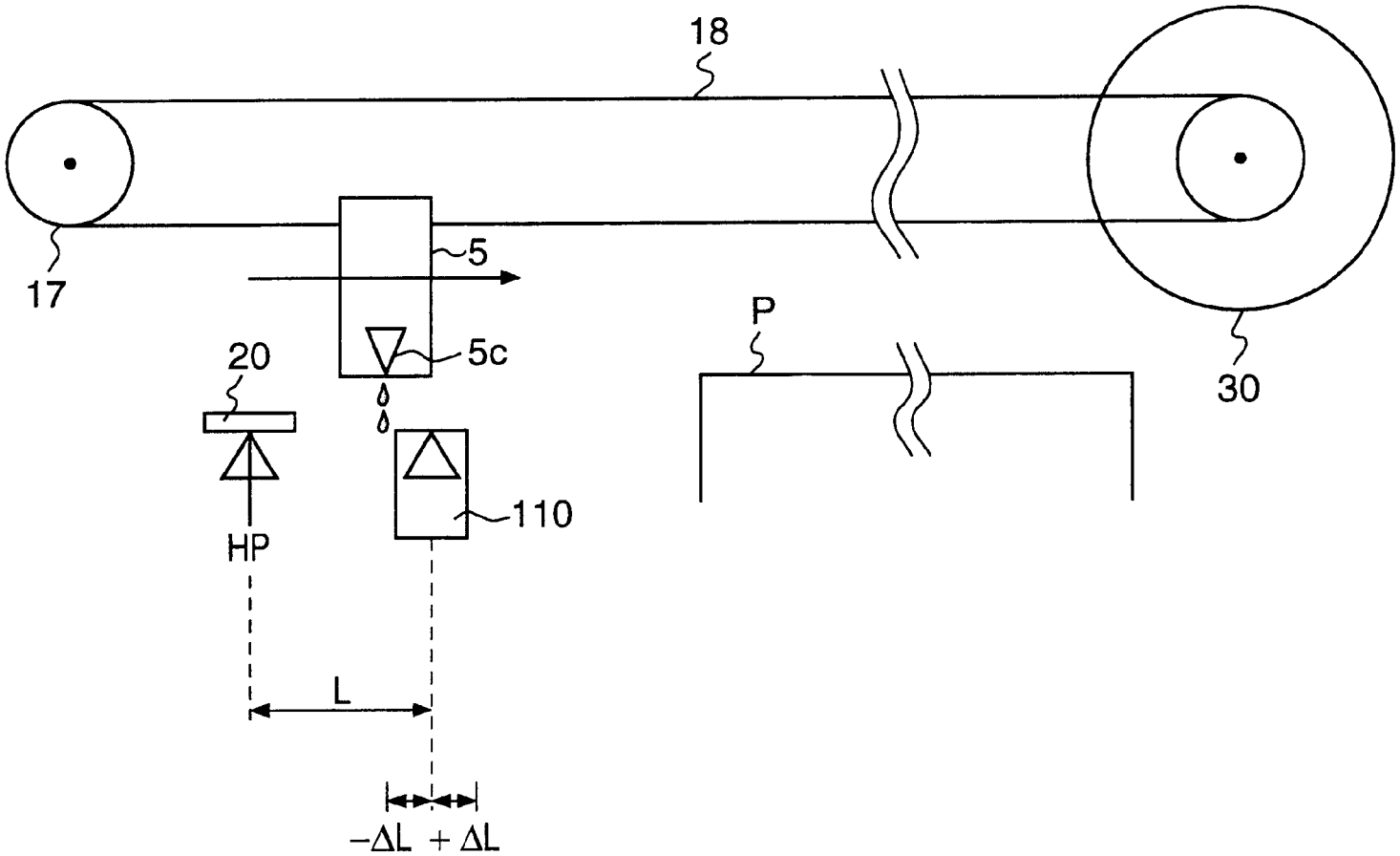
FIG. 2 is a schematic view showing the detailed construction around a ink detection sensor 110 according to a first embodiment.

FIG. 2 shows the construction around the ink detection sensor 110 according to a first embodiment.

In FIG. 2, numeral 5 denotes a printhead having a nozzle array 5*c* for discharging ink; and 20, a cap for capping the nozzle array 5*c*. The cap 20 is provided at a home position (HP).

As shown in FIG. 2, the ink detection sensor 110 is provided at a position opposite to the nozzle array 5*c* of the printhead 5, between one end of a print sheet P and the cap 20 at the home position. The ink detection sensor 110 is a photo-interruptive type sensor which optically detects ink droplets discharged from the nozzles of the printhead 5. The MPU 101 detects whether or not ink droplets have been discharged from the printhead 5 (or ink tank or ink cartridge) based on output from the ink detection sensor 110, and determines whether the remains or is exhausted.

The ink detection sensor 110 uses an infrared LED as a light-emitting device. The infrared LED has an integrally formed lens with the LED light-emitting surface, and projects light toward a photo-reception device provided directly in the light path. The photo-reception device employs a photo-transistor having a 0.7 mm×0.7 mm hole, formed with a mold member, on a light axis, on its light-receiving surface. This hole defines a detection range between the photo-reception device and the light-emitting device to 0.7 mm in a height direction and 0.7 mm in a width direction. Further, the light axis connecting the light-emitting device and the photo-reception device is parallel to the nozzle array 5*c* of the printhead 5. The interval between the light-emitting device and the photo-reception device is longer than the length of the nozzle array 5*c*, so that when the position of the light axis and that of the nozzle array 5*c* coincide with each other, all ink droplets discharged from the respective nozzles of the printhead 5 pass through the detection range between the light-emitting device and the photo-reception device. As the ink droplets pass through the detection range, the ink droplets interrupt light from the light-emitting device, reducing the amount of light received by the photo-reception device, which changes output from the photo-transistor.

The photo-transistor output is A/D converted and sent to the MPU 101. The MPU 101 determines whether ink remains or is exhausted based on the digital output.

For the purpose of positioning such that the nozzle array 5*c* of the printhead 5 and the ink detection sensor 110 are relatively opposite to each other, a carriage home sensor (not shown) provided in the apparatus main body is used, in addition to positioning of the printhead 5 with respect to the cap 20.

Note that in FIG. 2, numeral 17 denotes a pulley; 18, a belt to which the carriage (not shown) holding the printhead 5 is attached; and 30, a carriage motor for moving the carriage.

Figure 3:
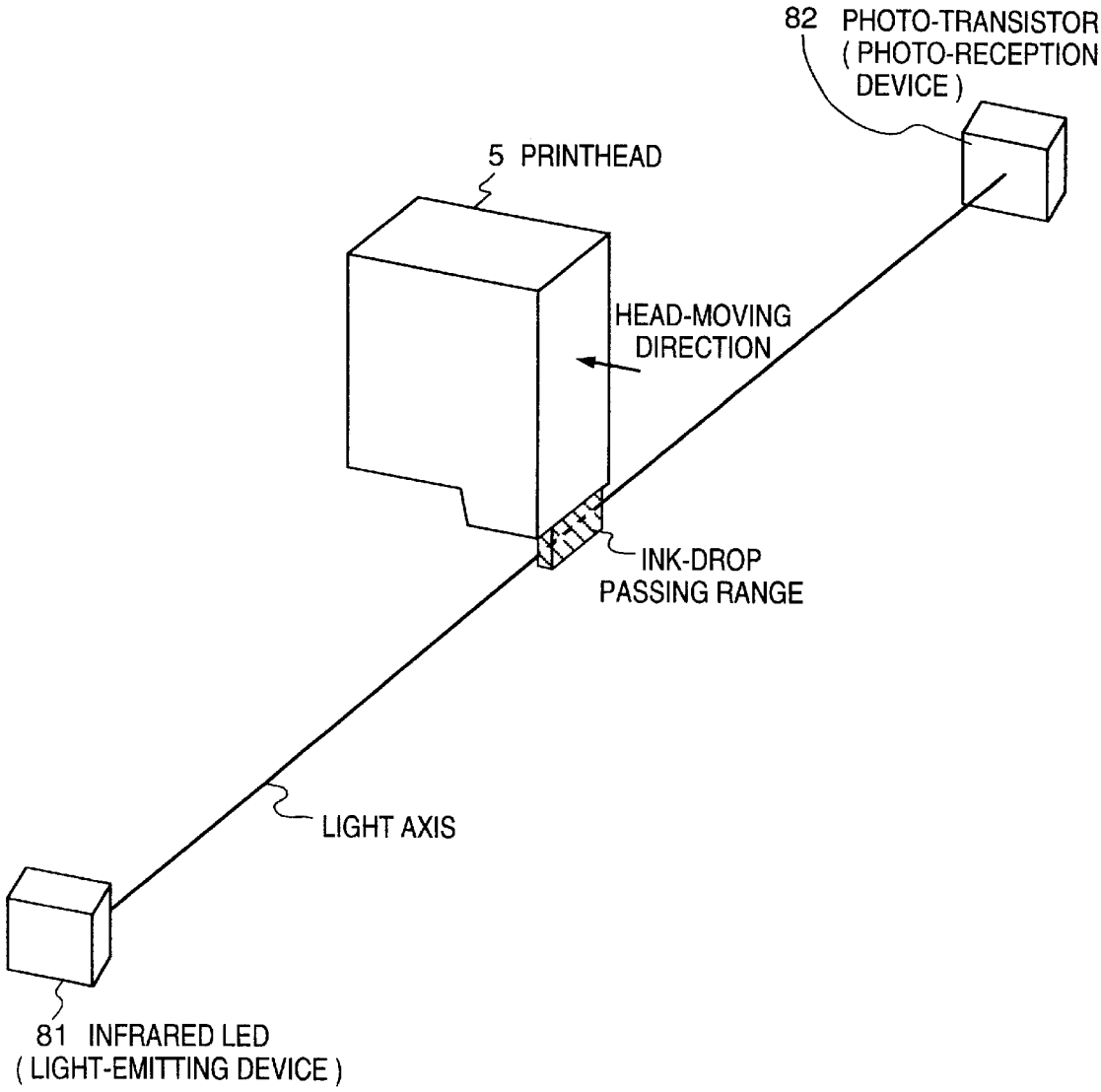
FIG. 3 is a perspective view showing how ink interrupts a light path from an infrared LED of the ink detection sensor 110.

FIG. 3 is a perspective view showing how ink droplets interrupt light from an infrared LED 81 as the light-emitting device of the ink detection sensor 110.

In this embodiment, after the home position (HP) as shown in FIG. 2 has been detected, the carriage is moved to a position (normal detection position) a predetermined distance (L) from the home position, then the position of the nozzle array 5*c* of the printhead 5 and the light axis of the ink detection sensor 110 are positioned relatively opposite to each other. After printing of one page has been completed, the printhead 5 is moved closer to the ink detection sensor 110. Then, as shown in FIG. 3, detection is performed by discharging ink such that ink droplets cross the light axis of light from the infrared LED 81 to a photo-transistor 82 as the photo-reception device. If the ink droplets cross the light axis to interrupt the light that arrives the photo-transistor 82, it is determined that the ink remains and is normally discharged.

It is apparent from FIGS. 2 and 3 that accurate determination cannot be made if the light axis of light between the infrared LED 81 and the photo-transistor 82 of the ink detection sensor 110 and the falling direction of the ink droplets do not intersect with each other. However, if the apparatus is set on a slope, the falling direction of the ink droplets does not exactly intersect the light axis of the light between the infrared LED 81 and the photo-transistor 82 of the ink detection sensor 110. Accordingly, in this embodiment, if ink droplets have not been detected at the initial test ink discharge, the printhead 5 is shifted by ±ΔL from the normal detection position, then test ink discharge is performed again. Thus the ink-discharge direction is caused to intersect the light axis.

The result of detection at the normal detection position and that of detection at the shifted position are compared, and if the change amount of photoelectric current detected at the photo-transistor 82, obtained from the detection at the shifted position, is greater than that at the normal detection position, the shifted position is set as a new normal detection position for the next ink detection.

In this embodiment, the light axis between the infrared LED 81 and the photo-reception device 82 of the ink detection sensor 110 and the ink-discharge direction always intersect with each other by the above control, and ink detection is performed in this status.

Figure 4:
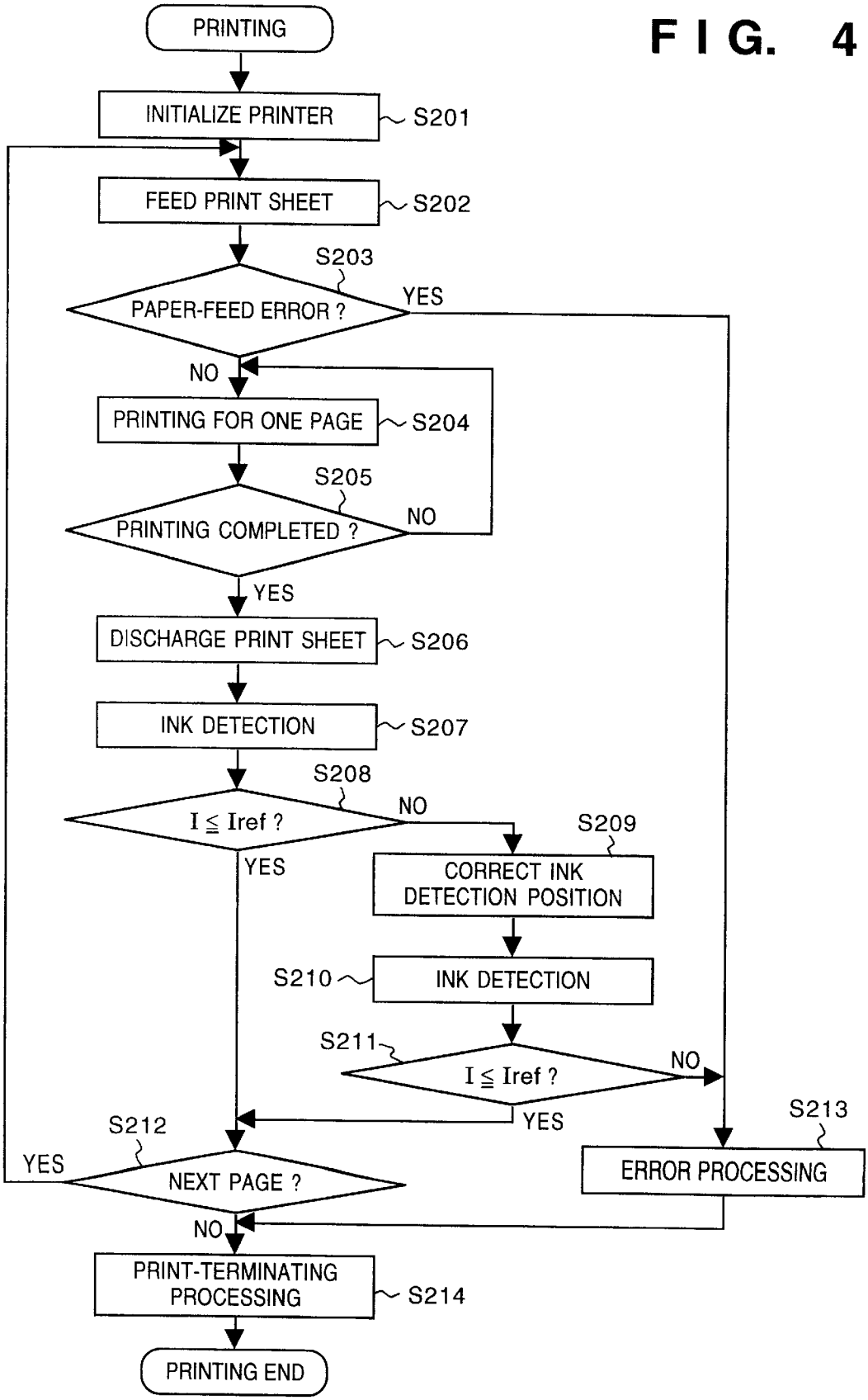
FIG. 4 is a flowchart showing print operation by the facsimile apparatus according to the first embodiment.

Next, the print operation and ink detection by the facsimile apparatus having the above construction will be described with reference to the flowchart of FIG. 4. Note that the print operation includes printing a received facsimile image, copying, based on an original image read by the reading unit 105 and outputting a report indicating various communication information, apparatus status and the like. Further, if the apparatus has an interface unit for receiving image data from a host computer (host), printing based on print data received from the host is also included in the print operation.

At step S201, as initial setting, various parameters for the print operation such as a print-sheet size, a printing margin and printing density are set. At step S202, the print sheet is fed from a paper cassette (not shown), and conveyed to a print-start position at which printing by the printhead 5 is possible. At step S203, it is examined whether or not the print sheet has not been fed or whether or not paper-jam has occurred. If it is determined that such paper-feed error has occurred, the process proceeds to step S213, at which a message requesting a user to deal with the paper-feed error is displayed on the LCD 107*b*, and the LED 107*c* is turned on, further, an alarm sound is emitted from the speaker 108; on the other hand, the content of the image memory, i.e., image data for printing, is held. Thereafter, the process proceeds to step S214.

If it is determined at step S203 that the paper-feed error has not occurred, the process proceeds to step S204, at which printing is performed based on image data for one page of print sheet. At step S205, it is examined whether or not the printing has been completed. If YES, the process proceeds to step S206, while if NO, returns to step S204 to continue the printing. At step S206, the print sheet, on which an image based on the image data has been printed, is discharged from the apparatus.

At step S207, ink discharge status is detected so as to determine whether or not the ink remains. As shown in FIGS. 2 and 3, the detection is made by discharging ink from the printhead 5 such that ink droplets interrupt light emitted from the light-emitting device 81 (LED) to the photo-reception device 82 (photo-transistor), and obtaining the reduction of photoelectric current detected from the photo-reception device 82. Assuming that the value of photoelectric current obtained at the photo-transistor 82 when ink discharge is not performed is "I", and the value of photoelectric current, obtained at the photo-transistor 82 when ink discharge is performed and used as a reference value for determining that ink remains, "$I_{ref}$", if $I \leqq I_{ref}$ holds, it is determined that the ink remains. On the other hand, if $I_{ref} < I$ holds, it is determined that the ink is exhausted. At step S208, the photoelectric-current value (I), obtained as the result of ink detection, is compared with the reference value ($I_{ref}$).

If it is determined that the ink is exhausted ($I > I_{ref}$), the process proceeds to step S209, at which the ink detection position is corrected by moving the printhead 5 by a small amount (±ΔL). At step S210, ink detection is performed again. At step S211, if it is determined that the ink is exhausted ($I > I_{ref}$), the process proceeds to step S213, at which error processing is performed to deal with the state where ink is not normally discharged. That is, a message is displayed on the LCD 107*b* to notify the user of the state, the LED 107*c* is turned on, and an alarm sound is emitted from the speaker 108; on the other hand, the image data in the image memory is held. If it is determined at step S211 that ink remains ($I \leqq I_{ref}$), the process proceeds to step S212. Hereinafter, it is controlled such that the subsequent ink detection is performed at the corrected position where the printhead 5 has been moved at step S209. If it is determined at step S208 that the ink remains ($I \leqq I_{ref}$), the process proceeds to step S212.

At step S212, it is examined whether or not image data for the next page exists. If YES, the process returns to step S202 to repeat the above operation. If NO, the process proceeds to step S214, at which a predetermined print-terminating processing is performed, and the process ends.

According to the above-described embodiment, even if it is determined as the result of ink detection that ink is exhausted, the printhead is moved by a small amount and ink detection is performed again. Printing is controlled on the result of the retried ink detection. That is, even if the position of the printhead is inappropriate for ink detection due to change of operational environment in which the apparatus is set, the position of the printhead for ink detection is corrected, thus ink detection can be performed at an appropriate position.

This enables more accurate ink detection corresponding to change of operational environment where the apparatus is placed.

In the above case, if ink droplets have not been detected, the position of the printhead is corrected and ink detection is performed only once more, however, the present invention is not limited to this number of times of detection. For example, it may be arranged such that in a case where ink droplets have not been detected, ink detection is repeated a predetermined number of times while changing the position of the printhead per each detection, and if ink droplets have not been detected at every detection point, the error processing is performed.

Note that in the above case, whether or not the apparatus has a printer capable of color printing has not been described. However, if the printing unit has a printhead for performing color printing with a plurality of color ink, the ink characteristics such as light transmittance, ink discharge amount, discharge frequency, discharge speed and the like, differ from one ink color to another, it is not preferable to perform ink detection with the same reference value ($I_{ref}$) or the same printhead-moving amount (±ΔL). Accordingly, in case of color printing, the reference value and printhead-moving amount are set with respect to each color ink, then ink detection can be performed in accordance with the respective color ink.

Further, in the above description, the printhead 5 is moved, however, the present invention is not limited to this arrangement. For example, the ink detection sensor 110 may be moved. Further, any construction that can change the relative positional relation between the ink detection sensor and the ink-discharge position may be employed.

Second Embodiment

Figure 5:
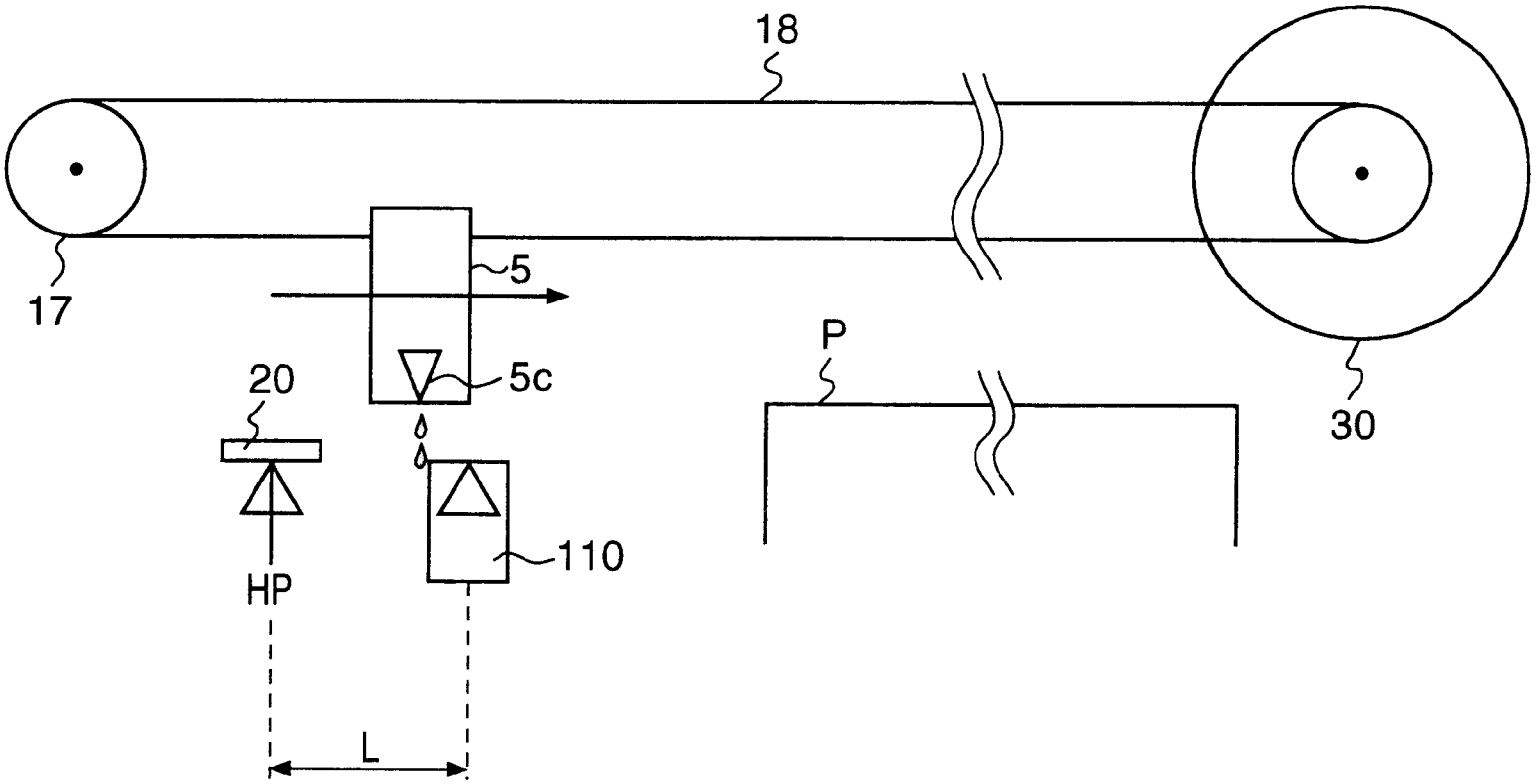
FIG. 5 is a schematic view showing the detailed construction around the ink detection sensor 110 according to a second embodiment.

FIG. 5 shows the construction around the ink detection sensor 110 according to a second embodiment. In FIG. 5, the elements corresponding to those in FIG. 2 have the same reference numerals, and the explanations of these elements will be omitted.

As shown in FIG. 5, after the home position (HP) has been detected, the carriage is moved by a predetermined amount (L), so that the nozzle array 5*c* of the printhead 5 and the light axis of light from the light-emitting device 81 to the photo-reception device 82 are exactly positioned relatively opposite to each other. When printing for one page has been completed, the printhead 5 is moved close to the ink detection sensor 110, and as described in the first embodiment (FIG. 3), ink detection is performed by discharging ink such that ink droplets cross the light axis of light from the infrared LED as the light-emitting device 81.

Figure 6:
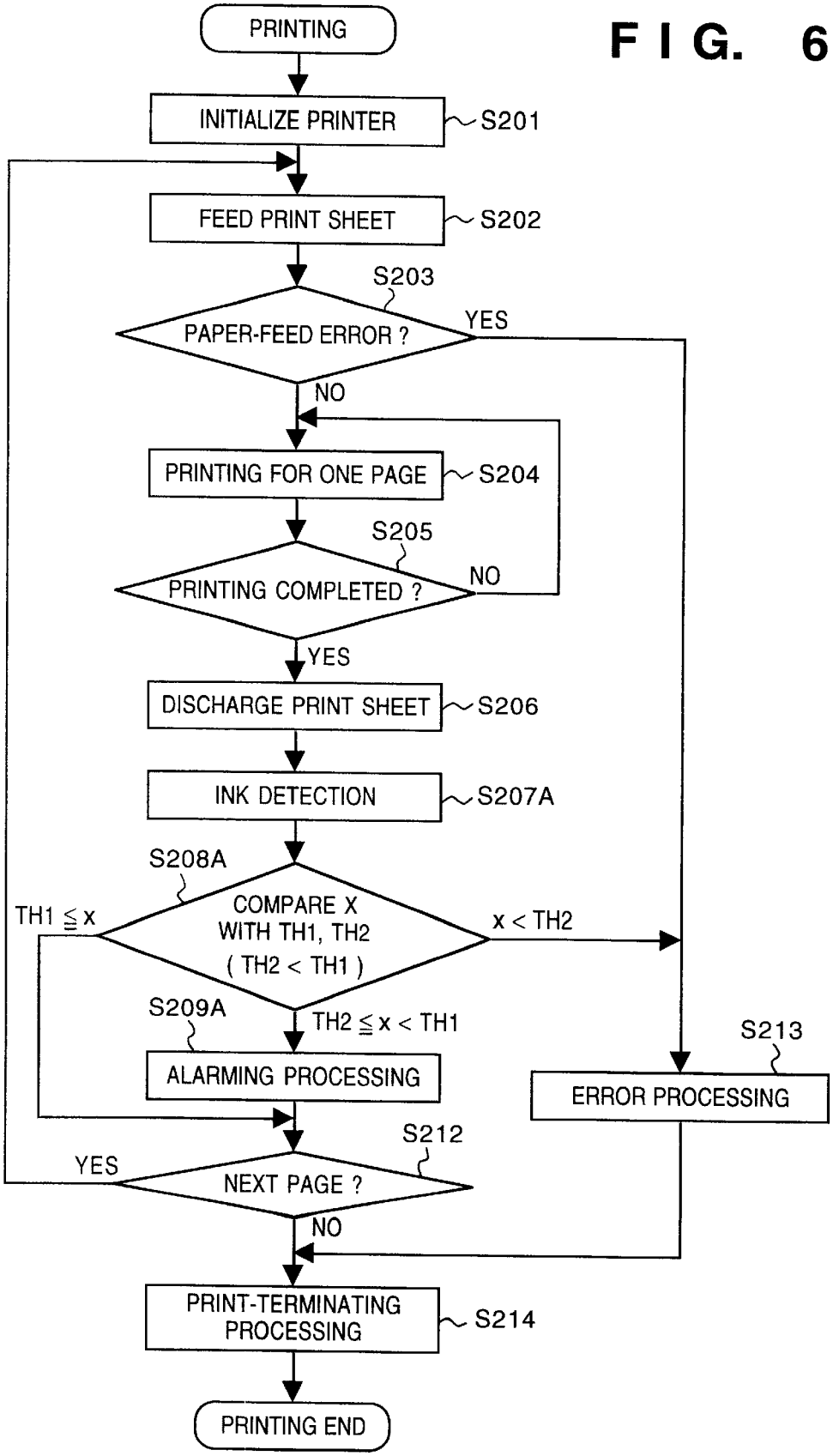
FIG. 6 is a flowchart showing the print operation by the facsimile apparatus according to the second embodiment.

Next, the print operation and ink detection operation by an apparatus having the above construction will be described with reference to the flowchart of FIG. 6. Note that as the print operation includes the print operation described in the first embodiment, the process steps corresponding to those in FIG. 4 have the same step numerals and the explanations of these steps will be omitted.

After the processing at steps S201 to S206, ink detection is performed at step S207A. As shown in FIGS. 3 and 5, this operation is made by discharging ink from the printhead 5 such that ink droplets interrupt light emitted from the light-emitting device 81 (LED) to the photo-reception device 82 (photo-transistor) of the ink detection sensor 110, and detecting the reduction of photoelectric current from the photo-reception device 82. Next, at step S208A, a ink parameter (x), converted from the reduction of photoelectric current is compared with two threshold values (TH1, TH2; TH2<TH1). If $TH1 \leqq x$ holds, it is determined that "residual ink amount is large", and the process proceeds to step S212. If $TH2 \leqq x < TH1$ holds, it is determined that "residual ink amount is small", and the process proceeds to step S209A. If $x < TH2$ holds, the process proceeds to step S213.

At step S209A, since the residual ink amount is small, a message is displayed on the LCD 107*b* requesting the user to exchange the ink cartridge for new cartridge or prepare a new ink cartridge, and for the purpose of an alarm, the LED 107*c* is turned on, and a predetermined alarm sound is emitted from the speaker 108. Note that the above process (step 209A) may be performed with holding the content of the image memory, taking into consideration the deterioration of printing quality caused by a small amount of ink. Thereafter, the process proceeds to step S212.

According to the second embodiment, if it is determined that the residual ink amount is small, a warning message is displayed, an alarm lamp is turned on, and an alarm sound is emitted. Thus the user can deal with this situation by, e.g., exchanging the ink cartridge for new one or preparing a new ink cartridge, before the ink becomes completely exhausted and printing cannot be normally performed.

In the above embodiment, the printer is not defined as a color printer or a monochrome printer, however, if the printer is a color printer, threshold values corresponding to respective ink colors are used for ink detection.

Especially, in a case where light transmittance differ dependent on ink color, due to the differences in color material or optical density, ink detection by using threshold values corresponding to the respective ink colors enables accurate determination.

In the above embodiment, two threshold values are used for estimating the residual ink amount, then in accordance with the result of estimation, alarming is made and the printing is stopped. However, the present invention is not limited to this number of threshold values, but the present invention is applicable to a case where three or more threshold values are used estimating the residual ink amount. Further, in such case, it may be arranged such that the content of the warning message, the color of the alarm lamp, and the type of alarm sound are changed based on the estimated residual ink amount. This enables stepwise alarming.

In the first and second embodiments, ink detection is performed when printing of one page has been completed, however, the present invention is not limited to this arrangement. For example, when the power of the apparatus is turned on, when the ink cartridge is exchanged for new one, when an instruction to perform ink detection has been inputted from the operation panel, or when facsimile image data has been received, ink detection can be performed. Otherwise, to reduce ink consumption, it may be arranged such that ink detection is not performed after each printing for one page, but performed at the above timings (i.e., upon turning the power on, upon exchanging the ink cartridge for new one, upon reception of ink detection instruction, and upon reception of facsimile image data). Furthermore, ink detection may be performed each time a predetermined number of pages for printing is completed. In case of a facsimile having a printing function, ink detection may be performed when a ink detection instruction command has been received from a host.

Further, the first and second embodiments, which have been independently described, may be combined as a facsimile apparatus having the construction of the first embodiment plus the construction of the second embodiment. In this case, the apparatus can perform ink detection with maintaining appropriate positional relation between the ink detection sensor and the printhead, by changing the relative positions of the sensor and the printhead in accordance with change of the operational environment, in addition, when the residual ink amount has become small, the apparatus can perform alarming to the user before the ink becomes exhausted.

The embodiments described above have exemplified a printer, which comprises means (e.g., an electrothermal transducer, laser beam generator, and the like) for generating heat energy as energy utilized upon execution of ink discharge, and causes a change in state of an ink by the heat energy, among the ink-jet printers. According to this ink-jet printer and printing method, a high-density, high-precision printing operation can be attained.

As the typical arrangement and principle of the ink-jet printing system, one practiced by use of the basic principle disclosed in, for example, U.S. Pat. Nos. 4,723,129 and 4,740,796 is preferable. The above system is applicable to either one of the so-called on-demand type or a continuous type. Particularly, in the case of the on-demand type, the system is effective because, by applying at least one driving signal, which corresponds to printing information and gives a rapid temperature rise exceeding film boiling, to each of electrothermal transducers arranged in correspondence with a sheet or liquid channels holding a liquid (ink), heat energy is generated by the electrothermal transducer to effect film boiling on the heat acting surface of the printhead, and consequently, a bubble can be formed in the liquid (ink) in one-to-one correspondence with the driving signal. By discharging the liquid (ink) through a discharge opening by growth and shrinkage of the bubble, at least one droplet is formed. If the driving signal is applied as a pulse signal, the growth and shrinkage of the bubble can be attained instantly and adequately to achieve discharge of the liquid (ink) with the particularly high response characteristics.

As the pulse driving signal, signals disclosed in U.S. Pat. Nos. 4,463,359 and 4,345,262 are suitable. Note that further excellent printing can be performed by using the conditions described in U.S. Pat. No. 4,313,124 of the invention which relates to the temperature rise rate of the heat acting surface.

As an arrangement of the printhead, in addition to the arrangement as a combination of discharge nozzles, liquid channels, and electrothermal transducers (linear liquid channels or right angle liquid channels) as disclosed in the above specifications, the arrangement using U.S. Pat. Nos. 4,558,333 and 4,459,600, which disclose the arrangement having a heat acting portion arranged in a flexed region is also included in the present invention. In addition, the present invention can be effectively applied to an arrangement based on Japanese Patent Laid-Open No. 59-123670 which discloses the arrangement using a slot common to a plurality of electrothermal transducers as a discharge portion of the electrothermal transducers, or Japanese Patent Laid-Open No. 59-138461 which discloses the arrangement having an opening for absorbing a pressure wave of heat energy in correspondence with a discharge portion.

Furthermore, as a full line type printhead having a length corresponding to the width of a maximum printing medium which can be printed by the printer, either the arrangement which satisfies the full-line length by combining a plurality of printheads as disclosed in the above specification or the arrangement as a single printhead obtained by forming printheads integrally can be used.

In addition, an exchangeable chip type printhead which can be electrically connected to the apparatus main unit and can receive an ink from the apparatus main unit upon being mounted on the apparatus main unit or a cartridge type printhead in which an ink tank is integrally arranged on the printhead itself can be applicable to the present invention.

It is preferable to add recovery means for the printhead, preliminary auxiliary means, and the like provided as an arrangement of the printer of the present invention since the printing operation can be further stabilized. Examples of such means include, for the printhead, capping means, cleaning means, pressurization or suction means, and preliminary heating means using electrothermal transducers, another heating element, or a combination thereof. It is also effective for stable printing to provide a preliminary discharge mode which performs discharge independently of printing.

Furthermore, as a printing mode of the printer, not only a printing mode using only a primary color such as black or the like, but also at least one of a multi-color mode using a plurality of different colors or a full-color mode achieved by color mixing can be implemented in the printer either by using an integrated printhead or by combining a plurality of printheads.

Moreover, in each of the above-mentioned embodiments of the present invention, it is assumed that the ink is a liquid. Alternatively, the present invention may employ an ink which is solid at room temperature or less and softens or liquefies at room temperature, or an ink which liquefies upon application of a use printing signal, since it is a general practice to perform temperature control of the ink itself within a range from 30° C. to 70° C. in the ink-jet system, so that the ink viscosity can fall within a stable discharge range.

In addition, in order to prevent a temperature rise caused by heat energy by positively utilizing it as energy for causing a change in state of the ink from a solid state to a liquid state, or to prevent evaporation of the ink, an ink which is solid in a non-use state and liquefies upon heating may be used. In any case, an ink which liquefies upon application of heat energy according to a printing signal and is discharged in a liquid state, an ink which begins to solidify when it reaches a printing medium, or the like, is applicable to the present invention. In this case, an ink may be situated opposite electrothermal transducers while being held in a liquid or solid state in recess portions of a porous sheet or through holes, as described in Japanese Patent Laid-Open No. 54-56847 or 60-71260. In the present invention, the above-mentioned film boiling system is most effective for the above-mentioned inks.

In addition, the ink-jet printer of the present invention may be used in the form of a copying machine combined with a reader, and the like.

The present invention can be applied to a system constituted by a plurality of devices or to an apparatus comprising a single device. Furthermore, the invention is also applicable to a case where the invention is embodied by supplying a program to a system or apparatus.

As many apparently widely different embodiments of the present invention can be made without departing from the spirit and scope thereof, it is to be understood that the invention is not limited to the specific embodiments thereof except as defined in the appended claims.

What is claimed is:

1. A printing apparatus for performing print operation such that a printhead discharges ink on a printing medium, comprising:

an ink tank containing the ink;

print means for performing printing by using said printhead;

detection means, including a light-emitting device for emitting light and a photo-reception device for receiving the light, for detecting a received light amount at said photo-reception device for ink detection, said detection means arranged such that said printhead discharges ink and the ink interrupts the light from said light-emitting device to said photo-reception device;

determination means for comparing the received light amount detected by said detection means with a predetermined threshold value, and determining whether or not ink is normally discharged from said printhead, based on a result of comparison; and detection control means responsive to a determination by said determination means that ink is not normally discharged from said printhead, said detection control means controlling said detection means to retry a detection operation after adjusting a relative position between said printhead and said detection means, based on the determination by said determination means.

2. The printing apparatus according to claim 1, wherein said detection control means controls said detection means to suppress the retried ink detection, responsive to a determination by said determination means that the ink is not normally discharged from said printhead.

3. The printing apparatus according to claim 1, wherein said detection control means controls said detection means to perform subsequent ink detection at the adjusted position, responsive to a determination by said determination means based on the result of the retried ink detection by said detection means that the ink is normally discharged from said printhead.

4. The printing apparatus according to claim 1, wherein said printhead performs color printing by discharging a plurality of color ink, and wherein the predetermined threshold value is set separately for each ink color.

5. The printing apparatus according to claim 1, wherein said light-emitting device is comprised of an LED, and said photo-reception device is comprised of a photo-transistor.

6. The printing apparatus according to claim 1, wherein said detection control means further controls said detection means to perform scheduled ink detection, at predetermined intervals or at a predetermined time.

7. The printing apparatus according to claim 6, wherein the predetermined time includes a time when the printing for one page of print sheet has been completed.

8. The printing apparatus according to claim 1, further comprising print control means for controlling said print means to suppress printing in a case where said determination means determines based on the result of retried ink detection by said detection means that the ink is not normally discharged from said printhead.

9. The printing apparatus according to claim 1, wherein said printhead is comprised of an ink-jet printhead which performs printing by discharging ink.

10. The printing apparatus according to claim 1, wherein said printhead discharges ink by utilizing thermal energy, and wherein said printhead has thermal-energy generators for generating the thermal energy to be provided to the ink.

11. The printing apparatus according to claim 1, wherein in a case where said determination means determines that the ink is normally discharged from said printhead, said determination means further compares a value converted from the received light amount with a plurality of threshold values, and estimates a residual ink amount.

12. The printing apparatus according to claim 11, further comprising alarm means for warning that the residual ink amount is small, based on the result of estimation by said determination means.

13. The printing apparatus according to claim 12, wherein said alarm means includes at least any one of:

display means for displaying a warning message;

an alarm lamp; and sound emitting means for emitting an audible alarm sound.

14. The printing apparatus according to claim 13, wherein said display means includes an LCD, said alarm lamp includes an LED, and said sound emitting means includes a speaker.

15. The printing apparatus according to claim 11, wherein said printhead performs color printing by discharging a plurality of color ink, and wherein the plurality of threshold values are set separately for each ink color.

16. The printing apparatus according to claim 11, further comprising print control means for controlling said print means to suppress printing in a case where said determination means determines based on the result of estimation by said determination means that the ink residual is exhausted.

17. The printing apparatus according to claim 1, further comprising reading means for reading an original, transmission means for transmitting data obtained by reading the original by said reading means, and reception means for receiving data to be printed as a facsimile image.

18. The printing apparatus according to claim 1, wherein said detection control means adjusts relative position by shifting a position of said printhead.

19. A method of detecting residual ink, in an ink tank arranged to supply ink for discharge from a printhead of an ink-jet printer comprising the steps of:

performing ink detection using detection means comprised of a light-emitting device for emitting light and a photo-reception device for receiving the light, said detection means arranged such that said printhead discharges ink and the ink interrupts the light from said light-emitting device to said photo-reception device, said step of performing ink discharge including the step of detecting a received light amount at said photo-reception device;

comparing the received light amount with a predetermined threshold value;

determining whether or not ink is normally discharged from said printhead, based on the result of comparison; and retrying the ink detection after adjusting a relative position among said printhead, said light-emitting device and said photo-reception device, based on a result of said determining step.

20. The method according to claim 19, wherein in a case where said determining step determines that ink is normally discharged from said printhead, a value converted from the received light amount is compared with a plurality of threshold values, and a residual ink amount is estimated.

21. The method according to claim 19, wherein adjustment of relative position is comprised of a shift in position of said printhead.

22. A printing apparatus including scanning means for scanning printing means, which includes an ink container containing ink, relative to a printing medium so as to perform printing on the printing medium by discharging the ink from said printing means, comprising:

detection means, provided within a scanning range of said printing means, for detecting a decrease of residual ink contained in said ink container; and detection control means for performing control of detecting the decrease of the residual ink by moving said printing means to a position where said detection means is provided, by using said scanning means, wherein said detection control means adjusts a position of said printing means in accordance with a result of detection by said detection means, and wherein said detection control means controls said detection means to retry a detection operation.

23. The apparatus according to claim 22, wherein said detection means optically performs ink detection.

24. The apparatus according to claim 22, wherein, in a case where it is determined that the detection operation by said detection means has not been normally performed, said detection control means controls a position movement of said printing means, and controls said detection means to retry the detection operation.

25. The apparatus according to claim 22, wherein, in case where the decrease of the residual ink is detected by said detection means, said detection control means controls a position movement of said printing means, and controls said detection means to retry the detection operation.

26. The apparatus according to claim 22, wherein said detection control means controls said detection means to suppress the retried detection operation, responsive to the result of detection by said detection means that the ink remains in said ink container.

27. The apparatus according to claim 22, wherein said detection control means controls said detection means to perform subsequent detection at the adjusted position, responsive to a result of the retried detection by said detection means that the ink remains in said ink container.

28. The apparatus according to claim 22, wherein said printhead is comprised of an ink-jet printhead which performs printing by discharging ink.

29. The apparatus according to claim 22, wherein said printhead discharges ink by utilizing thermal energy, and wherein said printhead has thermal-energy generators for generating the thermal energy to be provided to the ink.

30. A method of detecting residual ink contained in an ink container which is included in printing means, for printing on a printing medium by discharging ink, being scanned by scanning means relative to detection means for detecting a decrease of residual ink contained in said ink container, comprising the step of:

moving said printing means to a position where said detection means is provided;

detecting residual ink detection by said detection means;

adjusting a relative position between said printing means and said detecting means in accordance with a result of the residual ink detection by shifting said printing means relative to said detection means; and retrying the residual ink detection at the adjusted position.

31. The method according to claim 30, wherein, in a case where it is detected at said detecting step that the ink in the ink container is exhausted, the relative position is adjusted at said adjusting step.

* * * * *

UNITED STATES PATENT AND TRADEMARK OFFICE

CERTIFICATE OF CORRECTION

PATENT NO. : 6,123,406
DATED : September 26, 2000
INVENTOR(S) : Takashi Imai

It is certified that error appears in the above-identified patent and that said Letters Patent is hereby corrected as shown below:

Title page,
Under "Reference Cited - Foreign Patent Documents", delete the duplicative citations to "54-56847 5/1979 Japan" and "60-71260 4/1985 Japan".

Column 2,
Line 56, change "ink," to -- inks," --.

Column 3,
Line 24, change "ink," to -- inks, --;
Line 48, change "a preferred embodiment" to -- preferred embodiments --; and
Line 66, change "a" to -- an --.

Column 4,
Line 49, change "a" to -- an --.

Column 5,
Line 10, change "the remains" to -- the ink remains --.

Column 7,
Line 58, change "ink," to -- inks, --.

Column 8,
Line 37, change "a" to -- an --.

Column 9,
Line 33, change "a" to -- an --.

UNITED STATES PATENT AND TRADEMARK OFFICE

CERTIFICATE OF CORRECTION

PATENT NO. : 6,123,406
DATED : September 26, 2000
INVENTOR(S) : Takashi Imai

It is certified that error appears in the above-identified patent and that said Letters Patent is hereby corrected as shown below:

Column 12,
Line 6, change "ink," to -- inks, --; and
Line 53, change "ink," to -- inks, --.

Column 14,
Line 34, change "step" to -- steps --.

Signed and Sealed this

Sixteenth Day of October, 2001

*Attest:*

Nicholas P. Godici

NICHOLAS P. GODICI
*Acting Director of the United States Patent and Trademark Office*

*Attesting Officer*